US006883909B2

(12) United States Patent
Kanazawa et al.

(10) Patent No.: US 6,883,909 B2
(45) Date of Patent: Apr. 26, 2005

(54) PRINTING APPARATUS WHICH PREVENTS FLOATING OF A RECORDING SHEET

(75) Inventors: Manabu Kanazawa, Kanagawa (JP); Koichi Tanno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/136,383

(22) Filed: May 2, 2002

(65) Prior Publication Data

US 2002/0186291 A1 Dec. 12, 2002

(30) Foreign Application Priority Data

May 10, 2001 (JP) ..... 2001-139897

(51) Int. Cl.[7] ..... B41J 2/01
(52) U.S. Cl. ..... 347/104
(58) Field of Search ..... 347/104; 400/624, 400/625, 629

(56) References Cited

U.S. PATENT DOCUMENTS 4,723,129 A * 2/1988 Endo et al. ..... 347/56
5,393,151 A * 2/1995 Martin et al. ..... 347/104
5,527,123 A * 6/1996 Jackson et al. ..... 347/104
5,808,647 A * 9/1998 Kurata et al. ..... 347/104
5,897,259 A * 4/1999 Ahn ..... 347/104
6,092,892 A 7/2000 Taniguro et al. ..... 347/104
6,234,472 B1 * 5/2001 Juan ..... 271/194
6,293,670 B1 * 9/2001 Taniguro et al. ..... 347/104
6,361,230 B1 * 3/2002 Crystal et al. ..... 400/615

* cited by examiner

*Primary Examiner*—Thinh Nguyen
*Assistant Examiner*—Julian D. Huffman
(74) *Attorney, Agent, or Firm*—Fitzpatrick, Cella, Harper & Scinto

(57) ABSTRACT

A recording apparatus for recording on a recording sheet by a recording head includes a conveying roller for conveying the recording sheet, a pinch roller in contact with the conveying roller to rotate following the conveying roller, and a sheet pressure member pivotable on the rotational shaft of the pinch roller. The sheet pressure member prevents the recording sheet from floating, hence making it possible to prevent the recording sheet from interfering with the recording head for the prevention of the disturbance that may be given to recording and damage to the recording head.

14 Claims, 8 Drawing Sheets

PRINTING APPARATUS WHICH PREVENTS FLOATING OF A RECORDING SHEET

BACKGROUND OF THE INVENTION

1. Field of the Invention

The present invention relates to a recording apparatus that records by use of a recording head on a recording medium.

2. Related Background Art

FIG. 6 is a perspective view that shows the outer appearance of an ink jet recording apparatus in general.

In FIG. 6, a reference numeral 101 designates the chassis, which is formed by sheet metal work. The chassis 101 is provided with various parts to structure the recording apparatus. A reference numeral 102 designates a sheet-feeding device to stack recording sheets thereon, and feeds each of them to the recording portion after separating them one by one at the time of recording; 103, a carriage that mounts both an ink tank and a recording head (neither shown) and performs recording by discharging ink from the recording head to the recording sheet while scanning in the direction B along the metallic carriage shaft 104; and 107, a pinch roller holder attached to the chassis 101, which is provided with plural pinch rollers 108 rotational in the sheet conveying direction, and which presses the pinch rollers 108 against a sheet conveying roller 105 by use of pinch roller springs 120. The pinch rollers 108 and the sheet conveying roller 105 pinch the recording sheet to convey it as the sheet conveying roller 105 rotates. A reference numeral 106 designates a platen having ribs 106*a*, and the recording sheet is conveyed on the ribs 106*a*.

Since the recording sheet is not rigid, it is not necessarily practicable to convey the sheet with the degree of parallelism being kept exactly during the conveyance thereof. Particularly, in the case of the recording apparatus of ink jet type that records by discharging ink to a recording sheet, the moisture contained in ink results in the expansion of the recording sheet to make it wavy sometimes. The edges of the recoding sheet, in particular, tend to float, and in the worst case, rubbing takes place between the recording head and the sheet to disturb recording eventually.

FIG. 7 and FIG. 8 are perspective views that illustrate the principle part of the conventional structure that provides the prevention of rubbing between a recording sheet and a recording head. FIG. 7 shows the right edge side of the recording sheet, and FIG. 8 shows the left edge side thereof.

In FIG. 7, a reference numeral 109 designates a recording sheet, and 110, a right-side sheet pressure plate that engages with the platen 106 by use of a nail. The right edge 109*a* of the recording sheet 109 passes under the right-side sheet pressure plate 110 when the recording sheet is conveyed, thus preventing the right edge 109*a* of the recording sheet from floating and rubbing against the recording head.

For many recording apparatuses, the position of a recording sheet is determined with the right edge of the recording sheet as a reference. In this case, the widthwise differences of recording sheets present the positional differences at the right edge thereof. For example, an A-4 size and a LTR size (LETTER size) present a difference of approximately 6 mm in positions at the left edges of the recording sheets. Therefore, a left-side sheet pressure plate 111 has an extended left-edge pressure portion 111*a* for use with A-4 size media and a left-edge pressure portion 111*b* for use with LTR size media.

If a left-side sheet pressure plate for use with an A-5 or narrower sized recording sheet is arranged at a position corresponding to the left edge thereof, the A-4 size and other wider recording sheets abut against such left-side sheet pressure plate eventually. In this case, therefore, a sheet-pressure formation 107*a*, which is configured integrally with the pinch roller holder, 107 (the same in the case of mylar sheet and others), is arranged at the left edge of each size of the narrower recording sheets. Then, it is arranged to press the left edge of the corresponding recording sheet with the resiliency of such sheet-pressure formation.

As described above, however, if it is intended to press the left edge of each recording sheet having different width by use of one member, such as the left-side sheet pressure plate 111, the configuration thereof becomes complicated. Also, the sheet pressure plate is positioned between the recording sheet and the recording head. As a result, the plate thickness should be as thin as 0.2 mm to 0.3 mm approximately, and there is a possibility that deformation takes place in the A-4 size pressure portion 111*a*.

Also, the sheet pressure formation 107*a* that presses the left edge of recording sheets each having various widths is arranged to press the recording sheet with the resilient force to be generated by the deformation thereof. Therefore, this becomes resistance to the conveyance of the recording sheet to result in the possibility that the conveyance precision is degraded. If the number of the sheet pressure formations 107*a* increases, the potential of such degradation should become more inevitable.

SUMMARY OF THE INVENTION

It is an object of the present invention to provide a recording apparatus capable of preventing the left and right edges of a recording sheet from being warped or floating without degrading the conveyance precision thereof so as to also prevent the recording head from being rubbed.

It is another object of the invention to provide a recording apparatus, which performs recording on a recording sheet by use of a recording head, comprising a conveying roller to convey the recording sheet, a pinch roller pivotable following the conveying roller, and a sheet pressure member pivotable on the rotational shaft of the pinch roller, wherein the sheet pressure member prevents the floating of a recording sheet being conveyed.

DESCRIPTION OF THE PREFERRED EMBODIMENTS

Hereinafter, in conjunction with the accompanying drawings, the description will be made of the embodiments in accordance with the present invention.

(First Embodiment)

Figure 1:
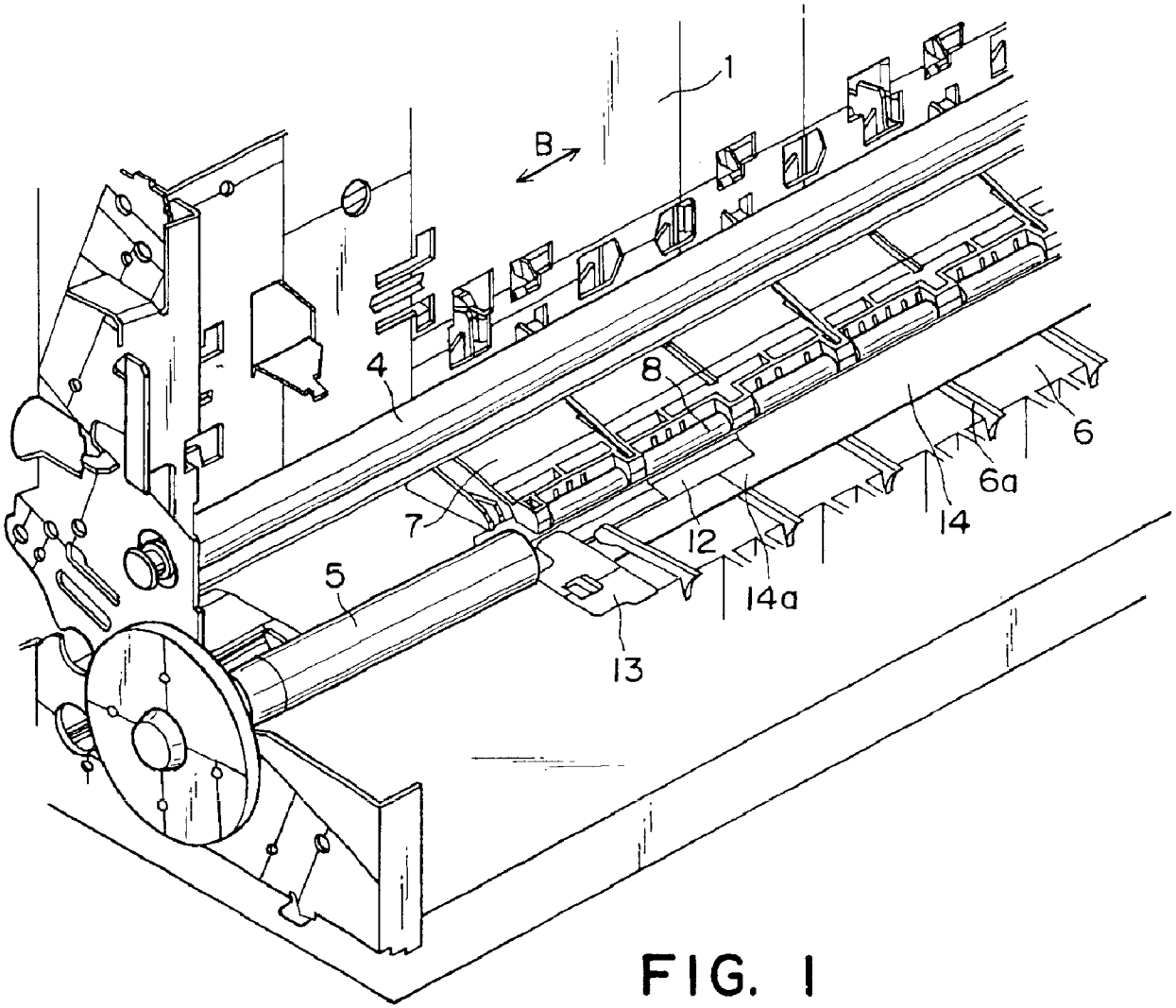
FIG. 1 is a perspective view that shows the principal part of the structure in accordance with a first embodiment of the present invention.

FIG. 1 is a perspective view that shows the principal portion of a first embodiment in accordance with the present invention.

Figure 6:
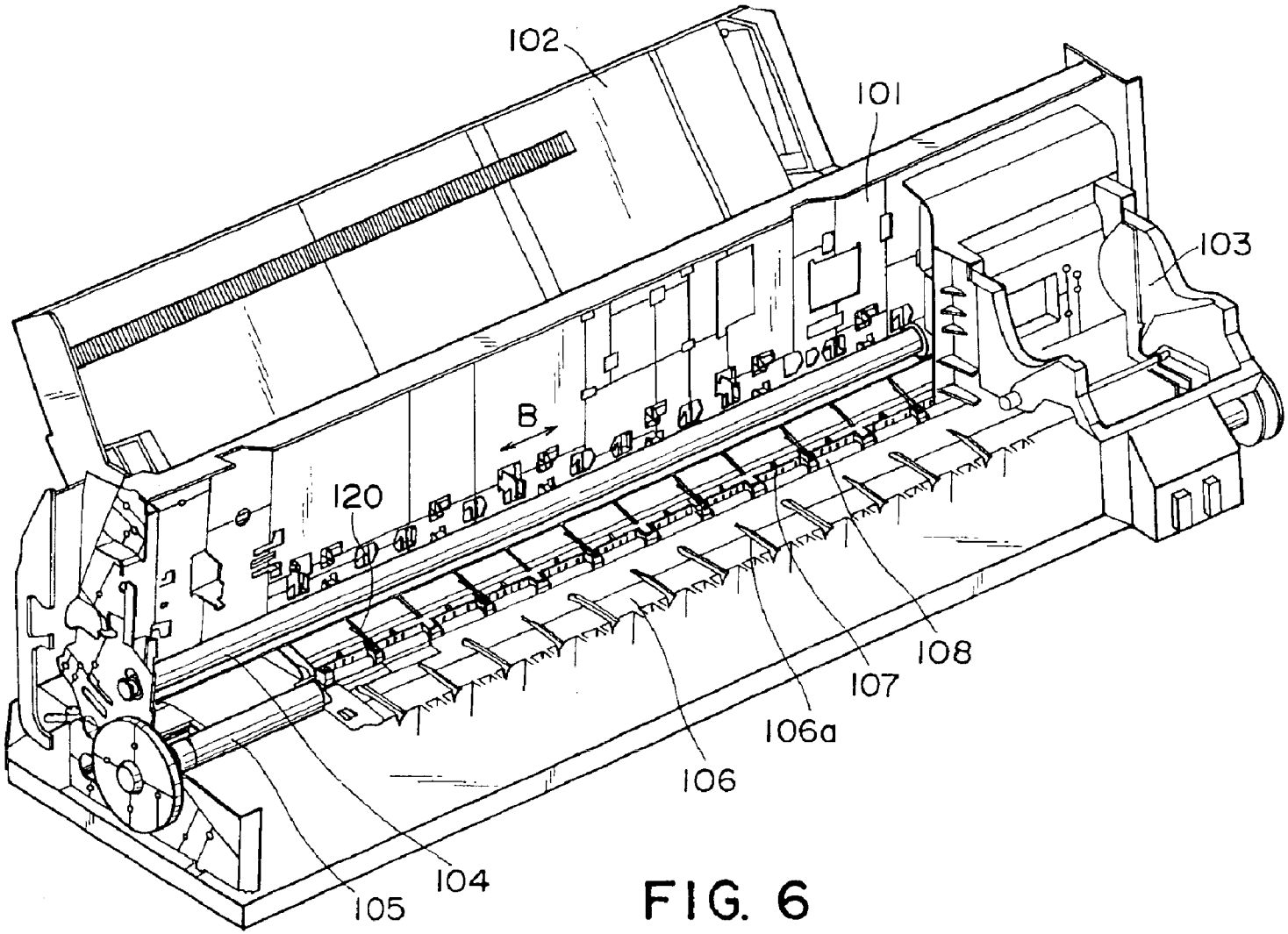
FIG. 6 is a perspective view that shows the outer appearance of a recording apparatus of ink jet type in general.
Figure 7:
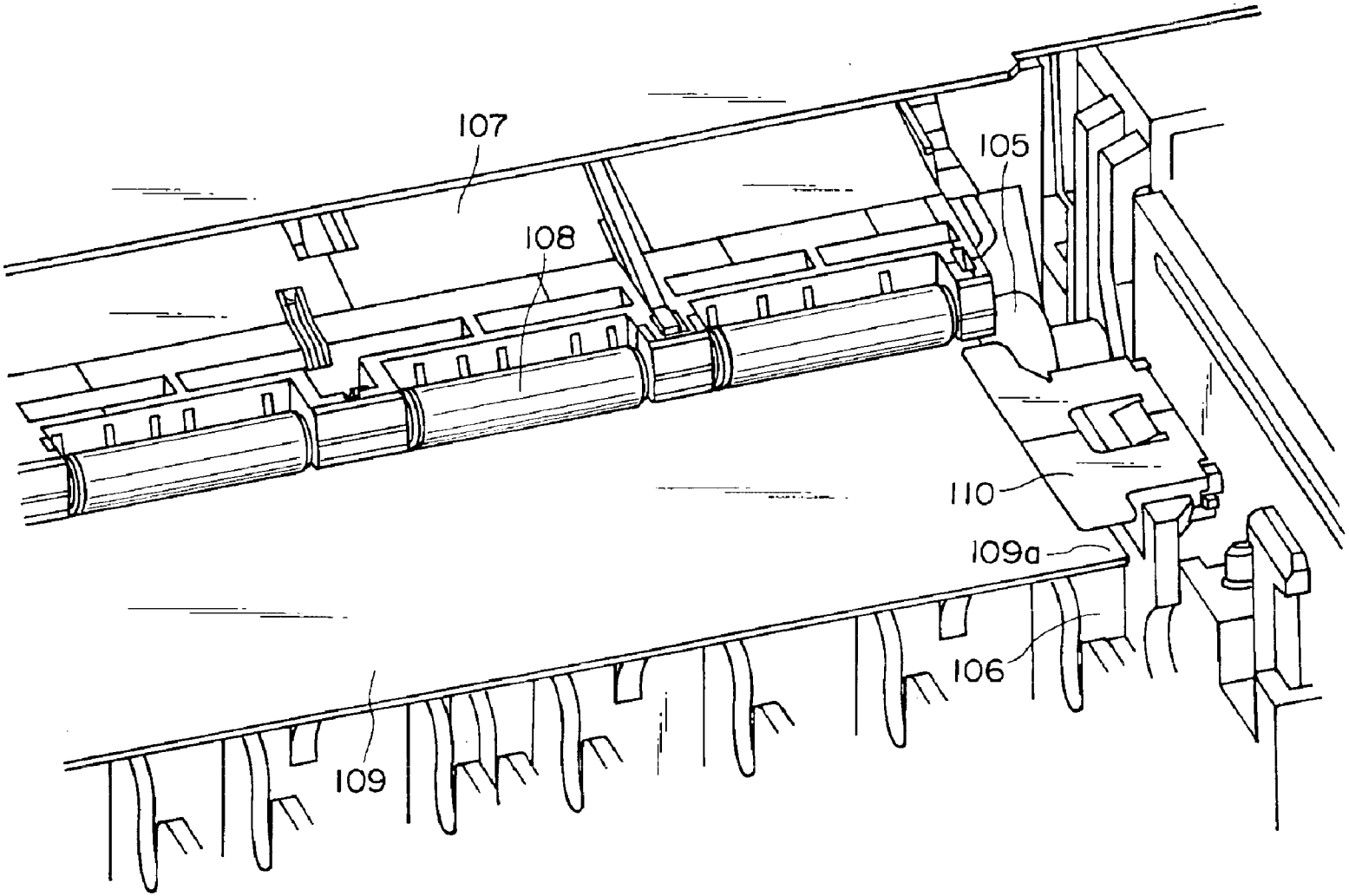
FIG. 7 is a perspective view that shows the principal part of the conventional structure having a preventive measure against rubbing between a recording sheet and a recording head.
Figure 8:
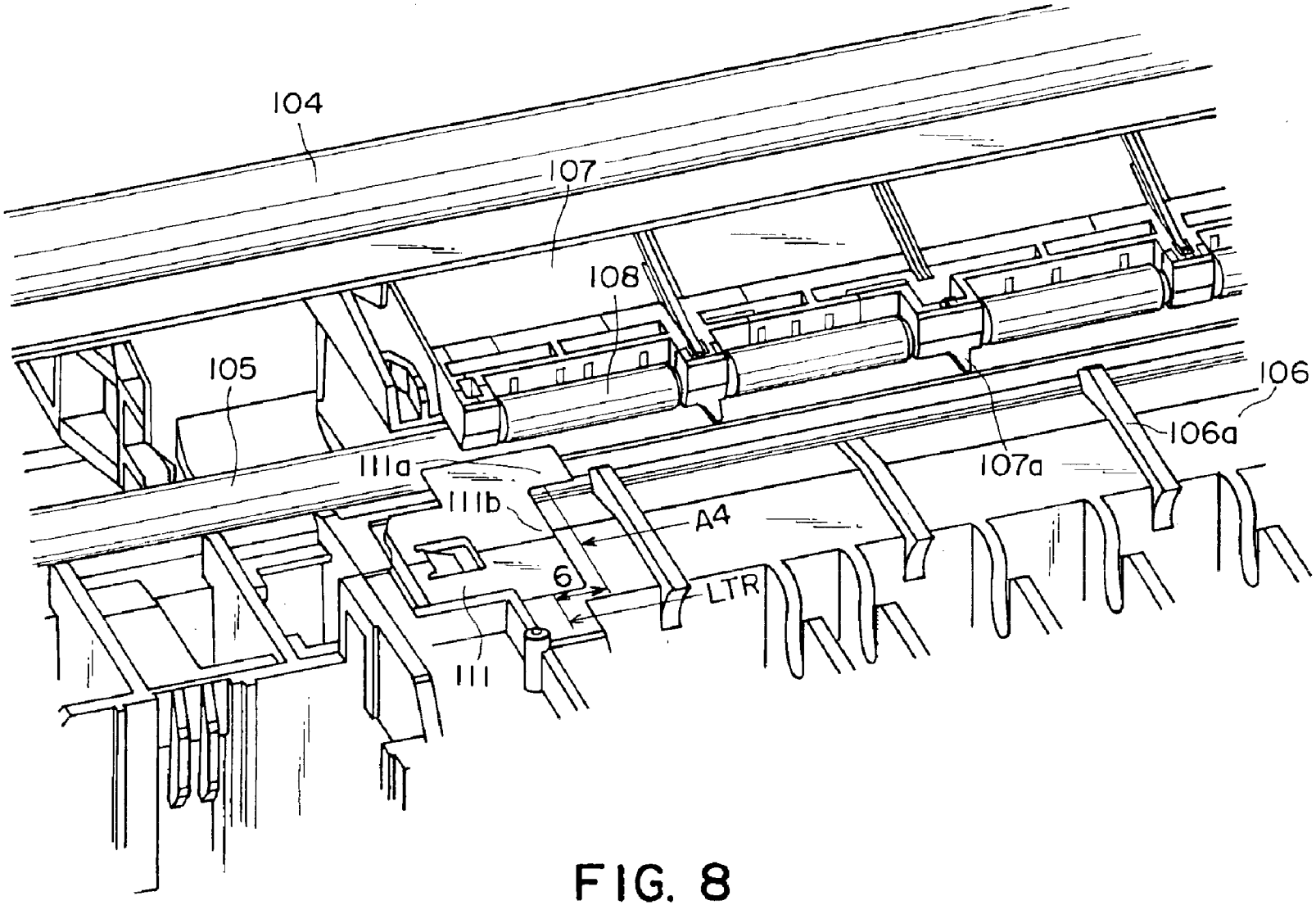
FIG. 8 is a perspective view that shows the principal part of the conventional structure having a preventive measure against rubbing between a recording sheet and a recording head.

The present embodiment is a recording apparatus having the same structure for the entire body as that of the conventional example shown in FIG. 6. In FIG. 1, the portion that is related to the sheet pressure mechanism, representing the principal part thereof, is shown. In FIG. 1, a recording sheet 14 is the one the width of which is smaller than the maximum widthwise specification. Here, a reference numeral 12 designates a sheet pressure member, which is structured to pivot on a rotational shaft (not shown) of a pinch roller 8. The sheet pressure member 12 is arranged on the position over a left edge portion 14*a* of the recording sheet 14 that has the maximum width. A reference numeral 13 designates a left-side sheet pressure plate arranged on the position over a left edge portion of the recording sheet of the maximum width. A reference numeral 7 designates a pinch roller holder, which is arranged for a chassis 1 and which is provided with plural numbers of pinch rollers 8 pivotable in the sheet conveying direction, and which presses the pinch rollers 8 to a sheet-conveying roller 5 by use of pinch roller springs (not shown). The pinch rollers 8 and the sheet-conveying roller 5 pinch the recording sheet 14 to convey it as the sheet-conveying roller 5 rotates. A reference numeral 6 designates a platen provided with ribs 6*a*, and the recording sheet 14 is conveyed on ribs 6*a*; and 4, a metal carriage shaft that guides a carriage (not shown). The carriage mounts an ink tank and a recording head (neither shown), and records on the recording sheet by discharging ink from the recording head, while scanning in the direction B along the carriage shaft 4.

Figure 2:
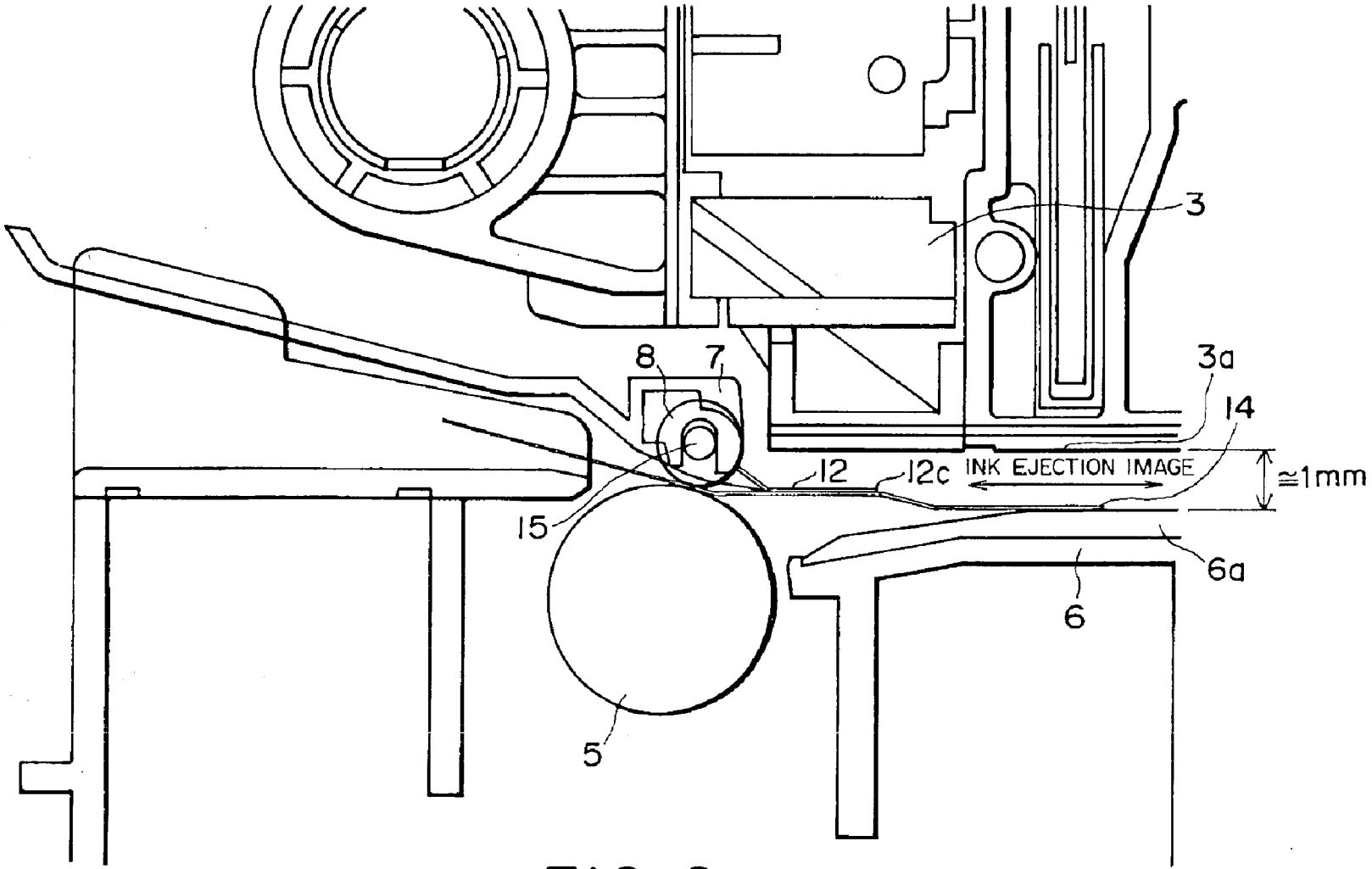
FIG. 2 is a cross-sectional view that shows the portion for the illustration of the operation of a sheet pressure plate.

FIG. 2 is a cross-sectional view of the portion that illustrates the operation of the sheet pressure member 12. In FIG. 2, a reference numeral 15 designates a pinch roller shaft that is arranged almost in parallel to the carriage shaft 4, and the sheet pressure member 12 is pivotable on the pinch roller shaft 15. The sheet pressure member 12 should enter a gap of approximately 1 mm between an ink discharge surface 3*a* of the recording head mounted on the carriage 3 and the ribs 6*a*. Usually, therefore, this member is structured by a metal plate of approximately 0.2 mm thickness, and presses the recording sheet 14 by its own weight. The rotational center of the sheet pressure member 12 is the same as that of the pinch roller shaft 15, and a leading end 12*c* of the sheet pressure member 12 is greatly deviated from the gravitational center to make the load exerted on the recording sheet 14 with the leading end 12*c* thereof just good enough to prevent the sheet from floating.

Also, the effect to press the recording sheet 14 becomes larger when pressure is applied to the recording sheet 14 as far as possible to the deep side (leading end) of the recording sheet. Therefore, the leading end 12*c* of the sheet pressure member 12 extends to the vicinity of the ink discharge portion, which is under the carriage 3.

Figure 3:
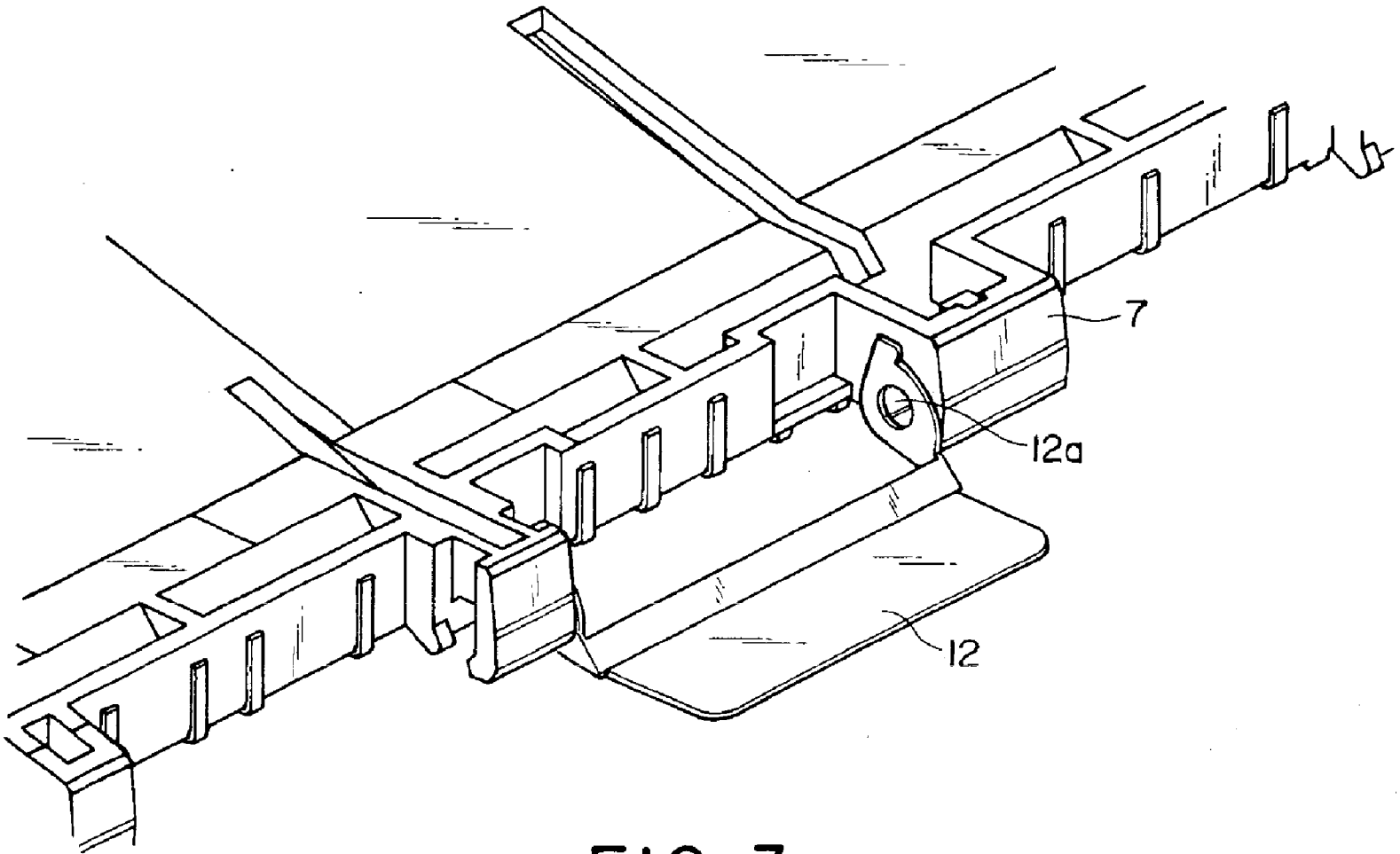
FIG. 3 is a perspective view that shows the positional relations between the sheet pressure plate 12 and a pinch roller holder.

FIG. 3 is a perspective view that shows the positional relations between the sheet pressure member 12 and the pinch roller holder 7. A rotational center 12*a* of the sheet pressure member 12 is pivotable on the pinch roller shaft 15 shown in FIG. 2 (not shown in FIG. 3).

As described above, in the vicinity of the pinch roller, there is arranged the recording sheet pressure plate mechanism, which is pivotable with the leading end thereof being positioned on the recording sheet. In this way, it becomes possible to press the sheet at the edge thereof even when the width of the recording sheet changes, and prevent the recording sheet, the edge thereof in particular, from floating. The recording sheet is then prevented from interfering with the recording head, hence making it possible to prevent disturbance of recording, and damage to the recording head as well.

Also, with the arrangement that the leading end of the sheet pressure member 12 extends under the recording head with the exception of the ink discharge portion, and that it presses up to such location, increases the range that the recording sheet is being pressed. In this manner, the effect to prevent the recording sheet from floating becomes higher still.

Also, the left-side sheet pressure plate 13 is good enough if only it can handle a recording sheet having the size of the maximum width because of the existence of the sheet pressure member 12, and it does not present any cause of deformation due to the complicated configuration needed to handle plural sizes of recording sheets as in the conventional art.

Also, with the rotational center of the sheet pressure member 12 being deviated from the gravitational center of the component, it becomes possible to prevent the recording sheet from floating by the weight of the sheet pressure member 12 itself. Therefore, the conveyance resistance becomes smaller than that of the recording sheet pressure formation that is arranged integrally with the pinch roller holder, thus making it possible to prevent the conveyance precision from being degraded.

(Second Embodiment)

Figure 4:
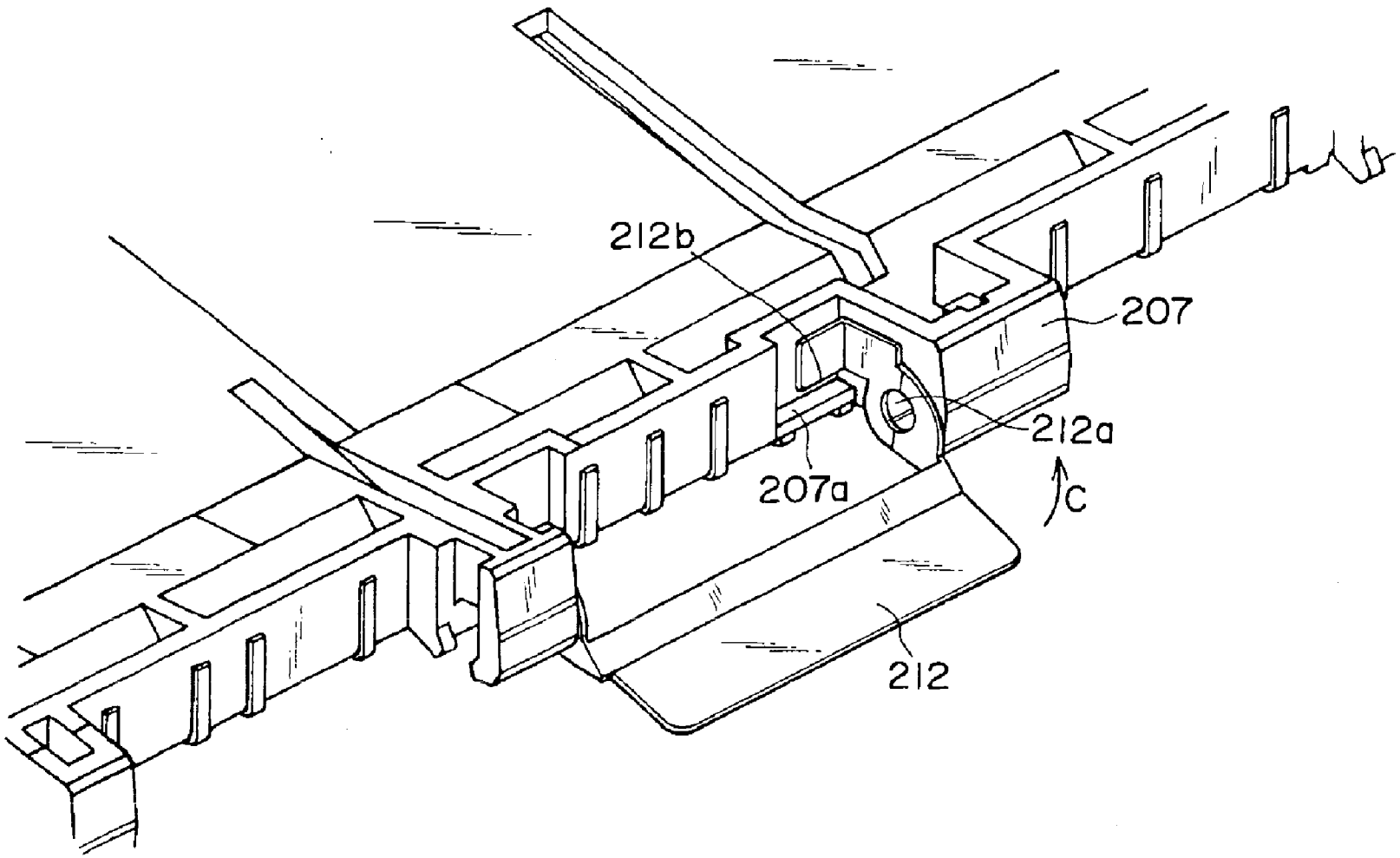
FIG. 4 is a perspective view that shows the principal part of the structure in accordance with a second embodiment of the present invention.

FIG. 4 is a perspective view that shows the principal structure in accordance with a second embodiment of the present invention. For the first embodiment, the sheet pressure member 12 is structured to be pivotable. Therefore, when a very thick recording sheet is conveyed or when the conveyance of overlapped recording sheets should take place, there is a possibility the leading end 12*a* of the sheet pressure member 12 is allowed to rise greatly to interfere with a recording head. The present embodiment is provided with a mechanism to limit the height to which the leading end of the sheet pressure member rises even when a very thick recording sheet should be conveyed or the conveyance of overlapped recording sheets should take place.

A sheet pressure member 212 of the present embodiment is provided with a stopper portion 212*b*, and a step 207*a* is formed for a pinch roller holder 207, which abuts against the stopper portion 212*b*.

Figure 5:
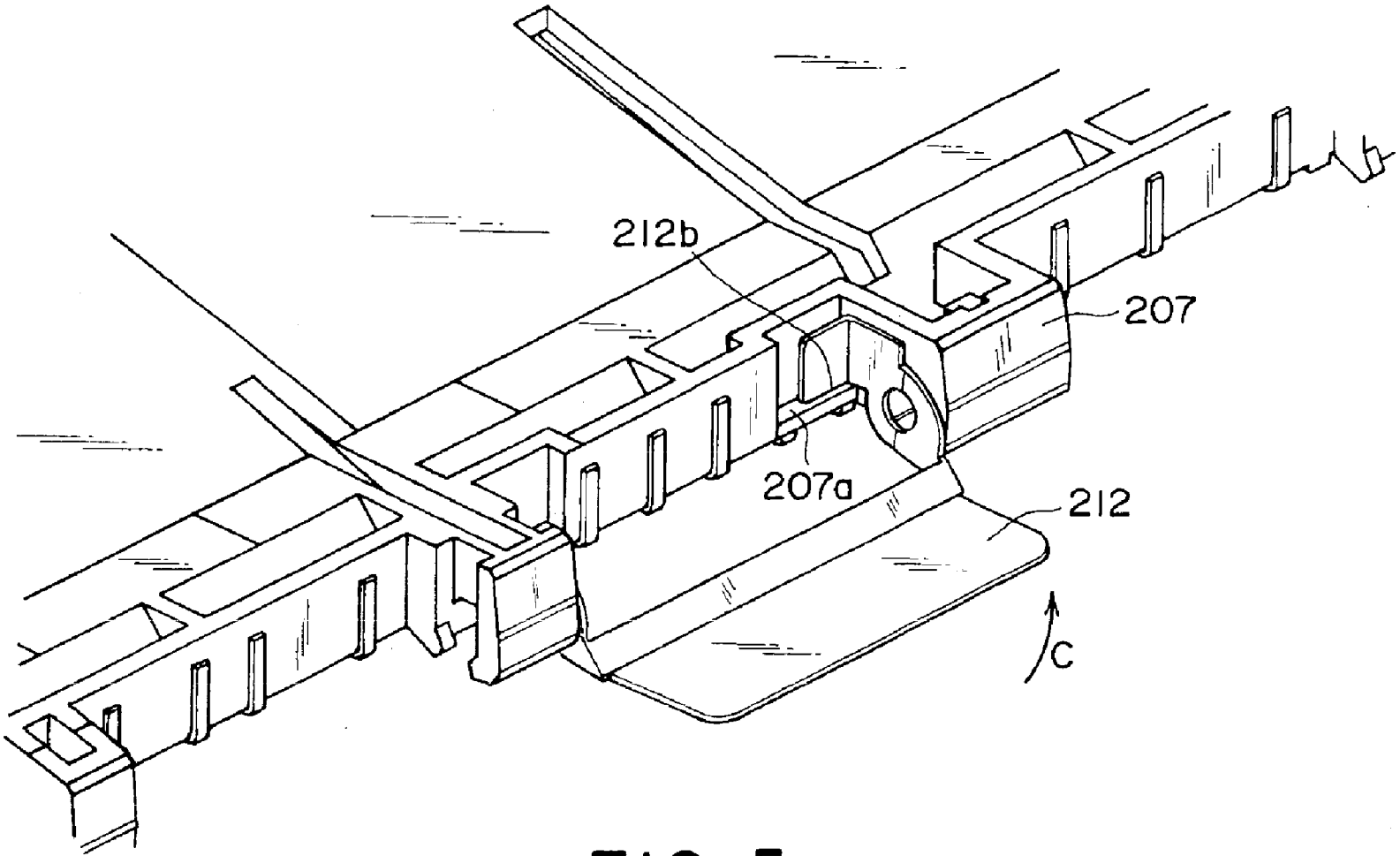
FIG. 5 is a perspective view that shows the principal part of the structure in accordance with a second embodiment of the present invention.

Now, description will be made of the rising amount of a leading end 212*a* of the sheet pressure member 212, which is restricted by means of the stopper portion 212*b* and the step 207*a*. If plural recording sheets should be overlapped at the time of feeding to cause an overlapped conveyance to occur, the sheet pressure member 212 rotates in the direction C and the leading end 212*a* of the sheet pressure member 212 is allowed to rise as shown in FIG. 5. Then, the stopper portion 212*b* and the step 207*a* abut against each other before this member interferes with the recording head, thus restricting the amount of rise of the leading end 212*a* of the sheet pressure member 212.

For the present embodiment, with the provision of the stopper mechanism for restricting the rising amount of the sheet pressure member 212 before the leading end 212*a* thereof and the recording head interfere with each other, it becomes possible to prevent the interference between the recording head and the sheet pressure member, thus preventing recording from being disturbed and the recording head from being damaged.

In this respect, for each of the embodiments described above, the pinch roller shaft is used as the rotational shaft of the sheet pressure member. These shafts may be separated as individual components. However, the common use of the shaft results in the reduction of the number of parts.

Also, since the sheet pressure member vertically presses the recording sheet from above by means of its own weight, the degree of arrangement freedom is high. Therefore, it may be possible to provide this member in plural numbers in order to handle plural recording sheets having different widths by arranging each of them in the corresponding position to press the left and right edges of each recording sheet. Also, it may be possible to arrange the structure so that one sheet pressure member, the length in the widthwise direction of which is made larger, is provided for handling plural recording sheets each having a different width.

Also, each of the above embodiments is structured so as to apply the present invention to a serial type recording apparatus that moves the recording head in the main scanning direction. However, the present invention is also applicable to a full line type recording apparatus that records images by use of the recording head that extends over the entire area in the widthwise direction of a recording sheet, while conveying the recording sheet continuously.

Also, for each of the above embodiments, the description has been made of the example in which of the ink jet type, the so-called BJ type, recording head is used, but the present invention is not necessarily limited thereto. It is applicable to various recording types. For example, besides the BJ type, the piezoelectric type may be adoptable as the recording method of the recording head.

As described above, in accordance with the embodiments of the present invention, the leading end of the sheet pressure member presses a recording sheet and is pivotable to the recording head side vertically above the recording sheet at the time of recording. Therefore, it becomes possible to prevent the recording sheet from floating without causing any deformation of the sheet pressure plate, which contributes to maintaining the sheet conveyance precision in good condition. With the provision of such sheet pressure members, each on positions to press the left and right edges of a recording sheets, or with the extension of the leading end of the sheet pressure member up to below a recording head, it is possible to demonstrate more advantageous effects.

Also, with the provision of the stopper mechanism that regulates the rotational angle of the sheet pressure member, it becomes possible to prevent the sheet pressure member from colliding against other structural members to be able to stabilize recording operation.

Further, the rotational shaft of a pinch roller is used commonly as the rotational shaft of a sheet pressure member, which contributes to reducing the numbers of components to make the costs of manufacture lower.

The present invention is particularly effective with respect to an ink jet recording apparatus in which a recording sheet may be expanded due to the moisture contained in ink, causing it to be wavy sometimes.

What is claimed is:

1. A recording apparatus for recording on a recording sheet with a recording head, comprising:

a conveying roller for conveying the recording sheet;

a plurality of pinch rollers in contact with said conveying roller to rotate following said conveying roller, said plurality of pinch rollers being arranged in a direction perpendicular to a conveying direction in which the recording sheet is conveyed;

a sheet pressure member pivotable on a rotational shaft of one of said plurality of pinch rollers, said sheet pressure member preventing the recording sheet from floating; and a platen, including a plurality of ribs, for guiding the recording sheet conveyed by said conveying roller, wherein said sheet pressure member has a width wider than that of each of said ribs, is arranged at a position over at least one of said ribs, and presses the recording sheet by its own weight, and wherein said sheet pressure member is arranged at a position corresponding to only an edge portion of the conveyed recording sheet, in the direction perpendicular to the conveying direction in which the recording sheet is conveyed.

2. A recording apparatus according to claim 1, wherein said sheet pressure member is arranged at a position corresponding to plural sizes of recording sheets.

3. A recording apparatus according to claim 1, wherein a leading end of said sheet pressure member extends up to below said recording head.

4. A recording apparatus according to claim 1, further comprising a stopper mechanism for regulating the rotational amount of said sheet pressure member, wherein said stopper mechanism permits said sheet pressure member to pivot within a predetermined range and regulates the rotational amount of said sheet pressure member so that the recording sheet may not contact said recording head.

5. A recording apparatus according to claim 4, wherein said sheet pressure member comprises a plate-shaped portion.

6. A recording apparatus according to claim 1, wherein said recording head is an ink jet recording head capable of discharging ink.

7. A recording apparatus according to claim 6, wherein said ink jet recording head is provided with an electrothermal converting element for generating thermal energy to be utilized for discharging ink.

8. A recording apparatus for recording on a recording sheet with a recording head, comprising:

a conveying roller for conveying the recording sheet;

a pinch roller in contact with said conveying roller to rotate following said conveying roller;

a platen, disposed downstream of said conveying roller with respect to a conveying direction, for supporting the recording sheet at a position opposite the recording head; and a sheet pressure member pivotable on a rotational shaft of said pinch roller, said sheet pressure member being disposed at only a position corresponding to a side edge of a recording sheet the size of which is different from the size of a recording sheet of a maximum size recordable by the recording apparatus, for preventing the recording sheet from floating.

9. A recording apparatus according to claim 8, further comprising ribs, provided on said platen, for guiding the recording sheet conveyed by said conveying roller, wherein said sheet pressure member has a width wider than that of each of said ribs, and is arranged at a position over said ribs.

10. A recording apparatus according to claim 9, wherein said sheet pressure member comprises a plate-shaped portion.

11. A recording apparatus according to claim 10, wherein said sheet pressure member presses the recording sheet by its own weight.

12. A recording apparatus according to claim 8, wherein said sheet pressure member is disposed at a position away from a plate member.

13. A recording apparatus for recording on a recording sheet with a recording head, comprising:

a conveying roller for conveying the recording sheet;

a plurality of pinch rollers in contact with said conveying roller to rotate following said conveying roller, said plurality of pinch rollers being arranged in a direction perpendicular to a conveying direction in which the recording sheet is conveyed;

a sheet pressure member pivotable on a rotational shaft of one of said plurality of pinch rollers, said sheet pressure member preventing the recording sheet from floating; and a platen, including a plurality of ribs, for guiding the recording sheet conveyed by said conveying roller, wherein said sheet pressure member has a width wider than that of each of said ribs, is arranged at a position over at least one of said ribs, and presses the recording sheet by its own weight, and wherein said sheet pressure member is configured to contact only an edge portion of the conveyed recording sheet, in the direction perpendicular to the conveying direction in which the recording sheet is conveyed.

14. A recording apparatus for recording on a recording sheet with a recording head, comprising:

a conveying roller for conveying the recording sheet;

a pinch roller in contact with said conveying roller to rotate following said conveying roller;

a platen, disposed downstream of said conveying roller with respect to a conveying direction, for supporting the recording sheet at a position opposite the recording head; and a sheet pressure member pivotable on a rotational shaft of said pinch roller, said sheet pressure member being configured to contact only a side edge of a recording sheet the size of which is different from the size of a recording sheet of a maximum size recordable by the recording apparatus, for preventing the recording sheet from floating.

* * * * *